US011105048B2

(12) United States Patent
Rasmusson et al.

(10) Patent No.: US 11,105,048 B2
(45) Date of Patent: Aug. 31, 2021

(54) SCREED DUAL CARRIAGE EXTENDER TUBE ORIENTATION

(71) Applicant: Caterpillar Paving Products Inc., Brooklyn Park, MN (US)

(72) Inventors: Tobin D. Rasmusson, Bloomington, MN (US); Ryan J. Schuette, Saint Michael, MN (US); John E. Jorgensen, Andover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 53 days.

(21) Appl. No.: 16/163,313

(22) Filed: Oct. 17, 2018

(65) Prior Publication Data

US 2020/0123715 A1 Apr. 23, 2020

(51) Int. Cl.
*E01C 19/42* (2006.01)
*E01C 19/48* (2006.01)

(52) U.S. Cl.
CPC ..... *E01C 19/42* (2013.01); *E01C 19/4873* (2013.01); *E01C 2301/16* (2013.01)

(58) Field of Classification Search
CPC ..... E01C 2301/16
See application file for complete search history.

(56) References Cited

U.S. PATENT DOCUMENTS 4,272,213 A * 6/1981 McGovarin ..... E01C 19/40 404/104
4,722,636 A 2/1988 Brock
4,969,773 A * 11/1990 Heims ..... E01C 19/42 404/104
4,986,695 A * 1/1991 Heims ..... E01C 19/42 404/104
4,991,995 A * 2/1991 Heims ..... E01C 19/42 404/118
5,568,992 A * 10/1996 Grembowicz ..... E01C 19/48 404/101
5,924,819 A * 7/1999 Breidenbach ..... E01C 19/42 404/104
6,203,243 B1 * 3/2001 Birtchet ..... E01C 19/42 404/104
6,890,125 B1 * 5/2005 Calder ..... E01C 19/42 404/104
7,651,295 B2 * 1/2010 Eppes ..... E01C 19/48 404/101

(Continued)

FOREIGN PATENT DOCUMENTS

CN 206828924 1/2018
EP 0908562 12/2004
EP 2201176 8/2013

*Primary Examiner* — Thomas B Will
*Assistant Examiner* — Katherine J Chu
(74) *Attorney, Agent, or Firm* — Schwegman, Lundberg & Woessner

(57) ABSTRACT

An asphalt paver machine includes a main screed and an extender screed. The extender screed is coupled and configured to move laterally relative to the main screed. The extender screed includes a first screed carriage movably coupled to the main screed by a first cylinder and a second cylinder diagonally arranged relative to one another, and a second screed carriage movably coupled to the first screed carriage by a third cylinder and a fourth cylinder diagonally arranged relative to one another.

23 Claims, 5 Drawing Sheets

(56) References Cited

U.S. PATENT DOCUMENTS

| | | | | |
|---|---|---|---|---|
| 8,221,026 | B2 * | 7/2012 | Munz | E01C 19/48 404/118 |
| 9,212,457 | B2 | 12/2015 | Wagner et al. | |
| 9,551,115 | B2 * | 1/2017 | Engels | G06T 7/20 |
| 10,794,015 | B2 * | 10/2020 | Schuette | E01C 19/48 |
| 2013/0142571 | A1 | 6/2013 | Graham et al. | |
| 2014/0328626 | A1 * | 11/2014 | Smieja | E01C 19/42 404/118 |
| 2016/0177517 | A1 * | 6/2016 | Engels | B62D 55/084 404/75 |

* cited by examiner

SCREED DUAL CARRIAGE EXTENDER TUBE ORIENTATION

BACKGROUND

Floating screed pavers commonly include a paving vehicle with a reservoir of asphalt material and a main screed which trails behind the paving vehicle to spread out, level, and compact the asphalt paving material. The main screed is connected to the paving vehicle by pivoted towing arms to permit the screed to "float" over the surface on which asphalt is to be applied. Additionally, in order to widen the asphalt paving path, screed pavers have included extendable screeds which can extend laterally outward from a main screed.

SUMMARY

In an example according to this disclosure, an asphalt paver machine includes: a main screed; and an extender screed coupled and configured to move laterally relative to the main screed, the extender screed comprising: a first screed carriage movably coupled to the main screed by a first cylinder and a second cylinder diagonally arranged relative to one another; and a second screed carriage movably coupled to the first screed carriage by a third cylinder and a fourth cylinder diagonally arranged relative to one another.

In an example, an asphalt paver machine comprising: a machine frame; a main screed having a screed frame coupled to the machine frame; and an extender screed coupled to the main screed, the extender screed comprising: a first screed carriage movably coupled to the main screed by a first extender tube and a second extender tube, the second tube parallel to and offset horizontally and vertically from the first tube; and a second screed carriage movably coupled to the first screed carriage by a third extender tube and a fourth extender tube, the fourth tube parallel to and offset horizontally and vertically from the third tube.

In an example, a method includes a method of making an extendable screed system includes: movably coupling an extender screed to a main screed, the extender screed configured to move laterally relative to the main screed, the extender screed comprising: a first screed carriage movably coupled to the main screed by a first extender tube and a second extender tube diagonally arranged relative to the first extender tube; and a second screed carriage movably coupled to the first screed carriage by a third extender tube and a fourth extender tube diagonally arranged relative to the third extender tube.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Asphalt pavers can use extendable screeds that extend from a base width to an extended width to pave different road sizes. One challenge with pavers including such screeds is maintaining enough stiffness between the main screed frame and the extended frames so that the extended frames do not deflect an excessive amount under load. Excessive deflection can cause unevenness and/or defects in the finished asphalt mat.

Figure 1:
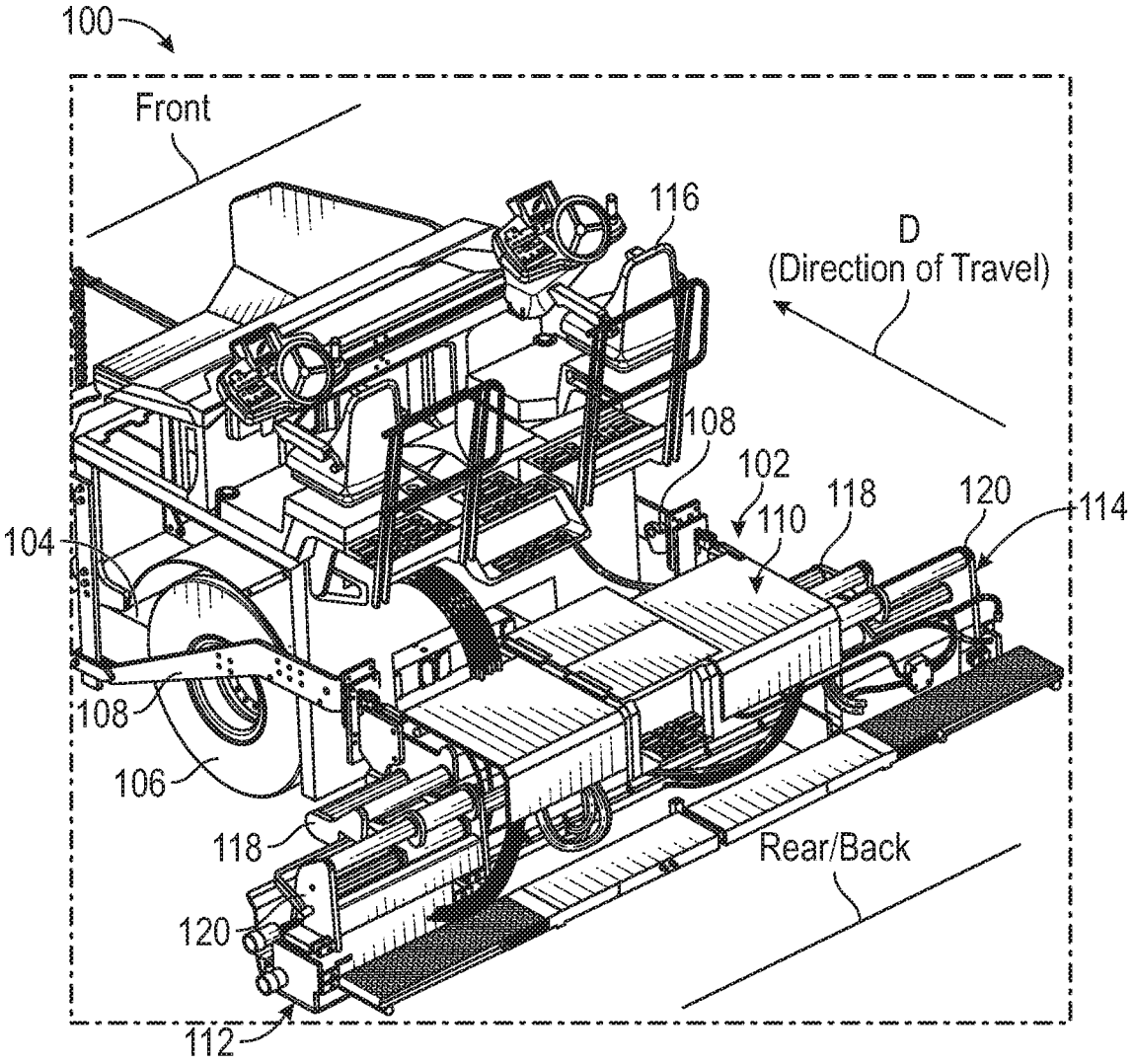
FIG. 1 depicts an example paving machine including an extendable screed system in accordance with this disclosure.

FIG. 1 is a perspective view depicting an example paving machine 100 including an extendable screed system 102. Paving machine 100 includes machine frame 104 and is configured to be transported over various terrains via wheels 106 (or another vehicle conveyance, including an endless track system). Extendable screed system 102 is movably coupled to paving machine 100, for example, machine frame 104 via two tow arms 108, disposed on opposite sides of the machine. In an example, screed system 102 is connected to paving machine 100 by pivoting towing arms 108 to permit the screed to "float" over the surface on which paving materials is to be applied.

Screed system 102 includes main screed 110, first extender screed 112 and second extender screed 114. First extender screed 112 is movably connected to main screed 110 and configured to extend laterally outward of one side of machine 100. Second extender screed 114 is movably connected to main screed 110 and configured to extend laterally outward of the opposite side of machine 100.

Paving machine 100 including screed system 102 is configured to spread, level and at least partially compact various materials, including asphalt, as an example. Paving machine 100 has front and rear/back ends. Generally speaking, the material to be laid onto terrain (for example, a road or work surface) is arranged or received at the front end of the work machine and conveyed toward the back end of the machine, where extendable screed system 102 processes the material by spreading the material out to a prescribed or target width with a prescribed or target depth/height, leveling the layer of material and at least partially compacting the material before additional material processing steps, e.g., additional compaction by a drum compactor machine.

Paving machine 100 travels in a direction, D, from the back toward the front of the machine, as indicated in FIG. 1. As an example, loose paving material can be deposited onto a work surface over which paving machine 100 is configured to travel. Paving machine 100 can include a system/mechanism/device, such as an elevator for moving loose paving material into a hopper or other reservoir/container. The paving material processed by paving machine 100 can be asphalt, aggregate materials and/or concrete, as examples. Paving machine 10 can travel in direction D, while a conveyor system moves paving material in the opposite direction from the front of the machine toward the extendable screed system 102 disposed at/toward the back of the machine.

In one example, an elevator picks up loose paving material in front of paving machine 100, as the machine travels in direction D, and deposits the material into a hopper or other reservoir. The loose material deposited in the hopper can then be conveyed toward a feed system, which feeds the material out of the back of machine 100 and into screed system 102. The paving material is processed by screed system 102 and, after processing and trailing machine 100, an at least partially compacted pad of paving material is laid including a consistent width and depth/height.

Example paving machine 100 can also include one or more operator control stations 116, disposed in which one or more operators can control operation of the machine. Paving machine 100 includes one or more power generators, a brake system. The power generator(s) provides motive power to move machine 100. The brake system can provide stopping/resistive power to slow or stop machine 100. The power generator(s) of machine 100 can include various power generation platforms, including, for example, an internal combustion engine, whether gasoline or diesel, or an electric motor. Additionally, the power generator will commonly be operatively coupled to one or more drive train components, including, for example, a transmission, which are configured to transmit the power generated by the power generator to wheels 108. In addition to propelling machine 100 over various terrains, power generated by the power generator can be used for various operational requirements of the machine, including operating an implement attached thereto, for example, extendable screed system 102.

Figure 2A:
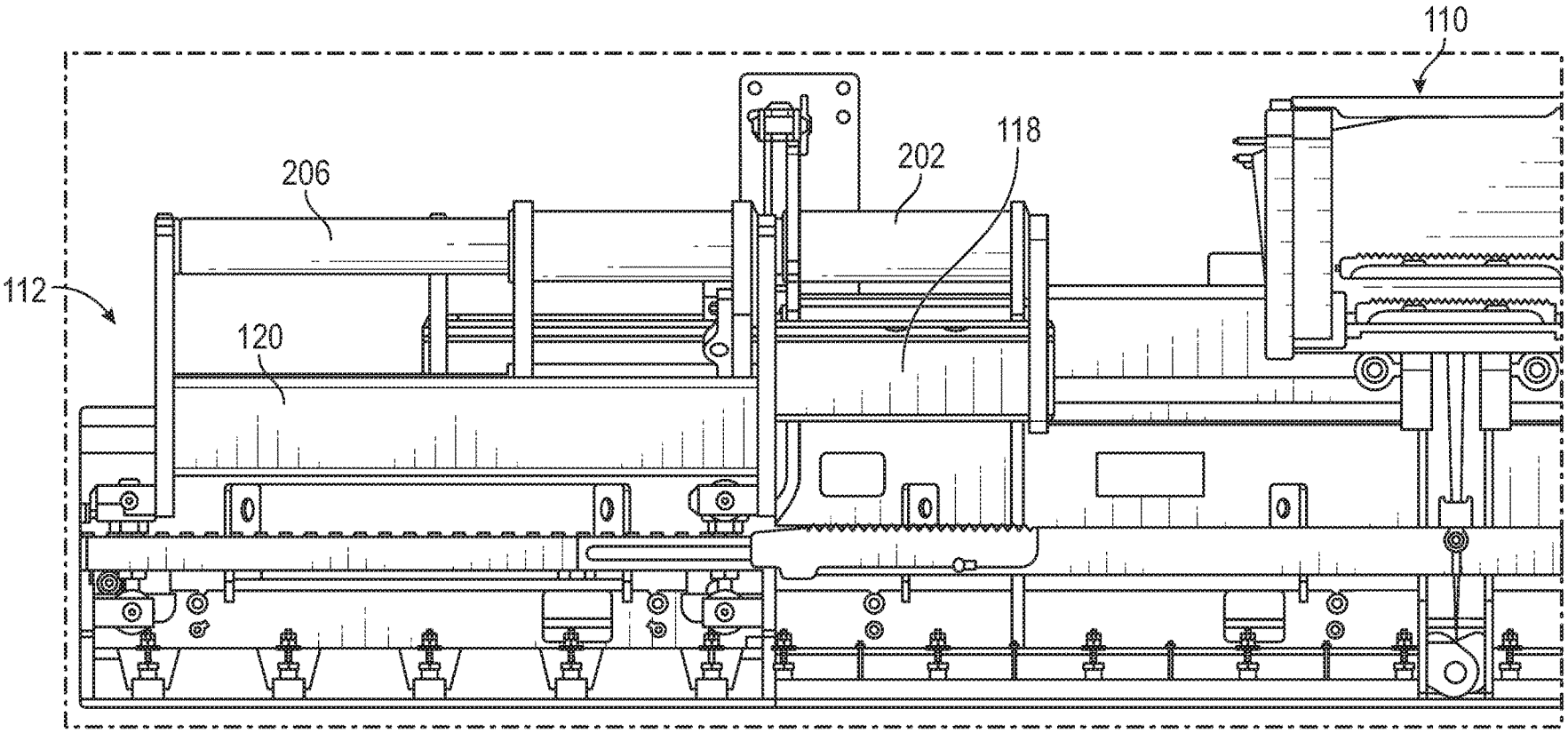
FIG. 2A is a rear elevation view of a portion of the extendable screed system of FIG. 1.
Figure 2B:
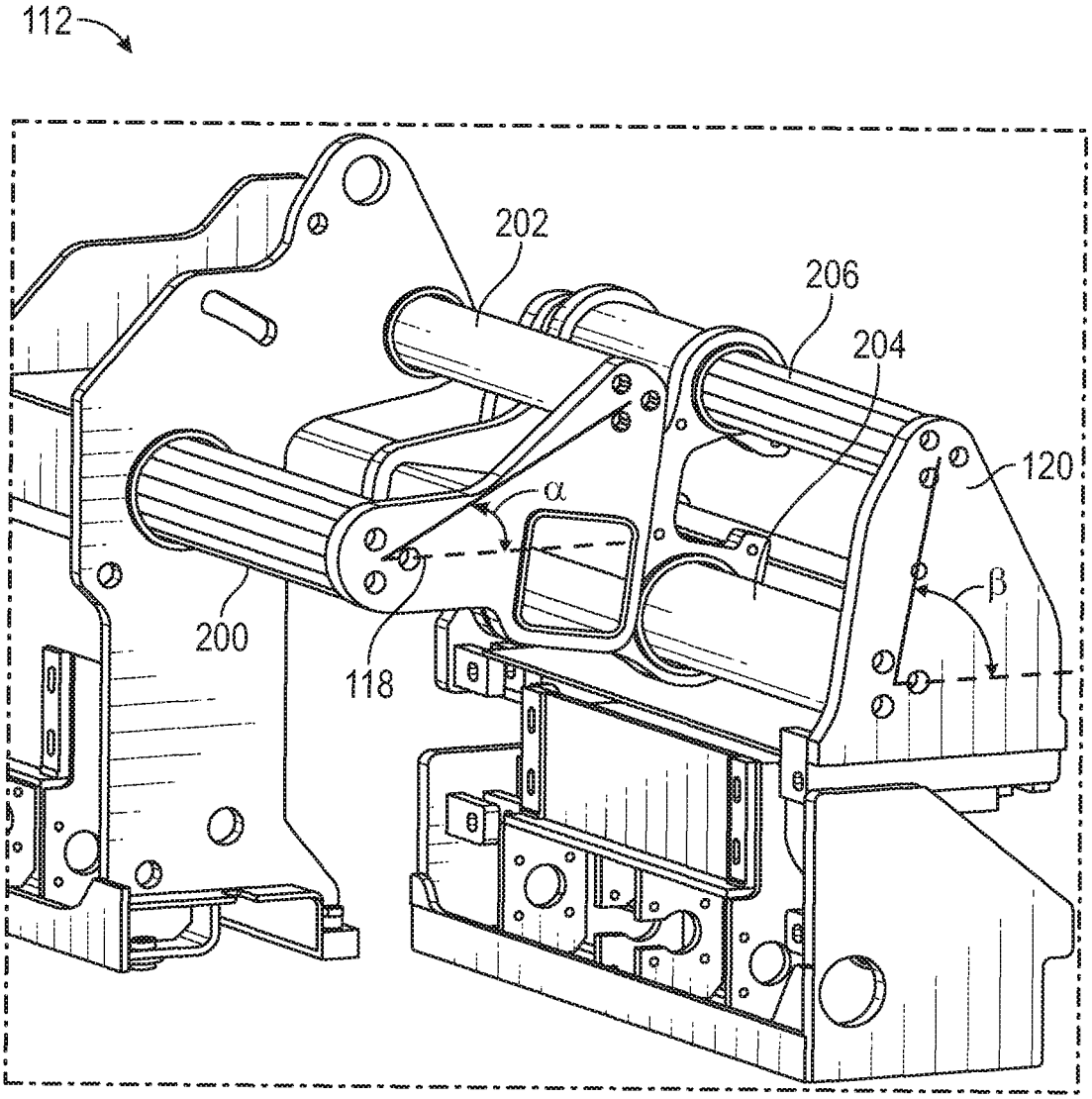
FIG. 2B is a perspective view of portions of a first extender screed of the extendable screed system of FIG. 1.

FIG. 2A is a rear elevation view of a portion of extendable screed system 102 depicting first extender screed 112 coupled to main screed 110. FIG. 2B is a perspective view of portions of first extender screed 112 decoupled from a main screed (for example, main screed 110 of FIGS. 1 and 2A) and/or paving machine (for example, paving machine 100). Referring to FIG. 1, each of extender screeds 112 and 114 include first and second screed carriages 118 and 120, respectively. First screed carriages 118 are disposed forward (toward front end of machine 100) of second screed carriages 120.

Referring to FIGS. 2A and 2B, first screed carriage 118 of first extender screed 112 is movably coupled to main screed 110 by first and second extender tubes 200 and 202, respectively. Second screed carriage 120 of first extender screed 112 is movably coupled to first screed carriage 118 by third and fourth extender tubes 204 and 206, respectively. In another example, second screed carriage 120 of first extender screed 112 can be movably coupled to main screed 110 by third and fourth extender tubes 204 and 206, respectively.

First, second, third and fourth extender tubes 200-206 can be a variety of different sizes and shapes configured to couple first and second screed carriages and allow the carriages to move laterally relative to main screed 110. In the example of FIGS. 1, 2A and 2B, extender tubes 200-206 are cylinders. In an example, extender tubes 200-206 are annular tubes, including annular cylinders. Extender tubes 200-206 can be, for example, circular or rectilinear (e.g., square) cylinders, including circular or rectilinear annular cylinders.

Lateral movement of extender screeds 112 and 114, respectively, can be actuated by a variety of devices, including, for example, a variety of linear actuators. For example, lateral movement of first and second extender screeds 112 and 114, respectively, can each be connected to main screed 110 by a linear actuator, which is configured to move first and second extender screeds 112 and 114, respectively, laterally outward of one side of machine 100.

In an example, first screed carriage 118 including extender tubes 200-206 can be connected to main screed 110 by a linear actuator configured to be actuated to cause first screed carriage 118 to move laterally outward via extender tubes 200-206. In one example, first screed carriage 118 can be connected to main screed 110 by one or more hydraulic or pneumatic cylinders configured to be actuated to cause first screed carriage 118 to move laterally outward via extender tubes 200-206. Alternatively or additionally, various types of linear actuators could be employed in examples according to this disclosure, including worm gear, rack and pinion, roller screw, traveling nut, lead screw, and ball screw, electro-mechanical actuators, linear slides with pneumatic, hydraulic, electrical, and/or mechanical actuation, among other example linear actuators.

Extender tubes 200-206 connect first extender screed 112 to main screed 110, allow the extender screed assembly/system to move laterally relative to the main screed, and also provide, along with other components including first and second screed carriages, structural support and rigidity to the extender screed assembly/system. The examples of FIGS. 2A and 2B, and the following description with reference to FIG. 3 focus on first extender screed 112 of the two extender screeds 112 and 114 of example paving machine 100. However, the features, components, functions, etc. of first extender screed 112 are or can be the same or substantially the same in second extender screed 114.

Referring to FIG. 2B, first and second extender tubes 200 and 202 are arranged diagonally relative to one another and to a horizontal reference of the machine to which first extender screed 112 is configured to be attached, e.g., paving machine 100. Similarly, third and fourth extender tubes 204 and 206 are arranged diagonally relative to one another and to the horizontal reference of the machine. In FIG. 2B, the diagonal arrangement and an angle defining the same is depicted as angle alpha, $\alpha$, for first and second tubes 200 and 202 and angle beta, $\beta$, for third and fourth tubes 206 and 208. The diagonal arrangement of first and second tubes 200 and 202 and of third and fourth tubes 204 and 206 may improve the strength and rigidity of first extender screed 112 by providing strength/rigidity in both the horizontal and vertical directions to counteract/counter balance the force of the terrain pushing vertically up on extender screed 112 and the force of the terrain pushing horizontally back as the screed travels forward along with the work machine (e.g., paving machine 100) to which the extender screed is attached.

The "horizontal reference of the machine" can be, for example, the terrain on which the machine is arranged during operation. Additionally, to the extent that relative terms like front, back, horizontal, vertically, etc. are used in describing features, components, functions, etc. in accordance with this disclosure, such terms are grounded in a frame of reference of a paving or other terrestrial work machine/vehicle. As such, horizontal can generally refer to a reference surface or plane that corresponds to the terrain on which the work machine is arranged and vertical can be a plane or vector or direction perpendicular to the horizontal reference. Vertically up versus down can be from the perspective of an observer on the horizontal reference, e.g., standing on the ground next to the machine. Additionally, front and back can be, as described above, defined by the direction of travel of the machine during normal operation with the direction of travel being defined as a direction from the back/rear end of the machine toward the front end, or, in other words, forward is the direction the machine travels with the front end leading the movement of the machine and the back end trailing the movement of the machine. Lateral movement or arrangement can reference movement or arrangement of a component relative to a middle or medial position of the machine, for example, the main screed of an extendable screed system may be arranged medially and the extender screeds may be arranged on and extend/move outward from opposite lateral sides of the main screed.

Figure 3A:
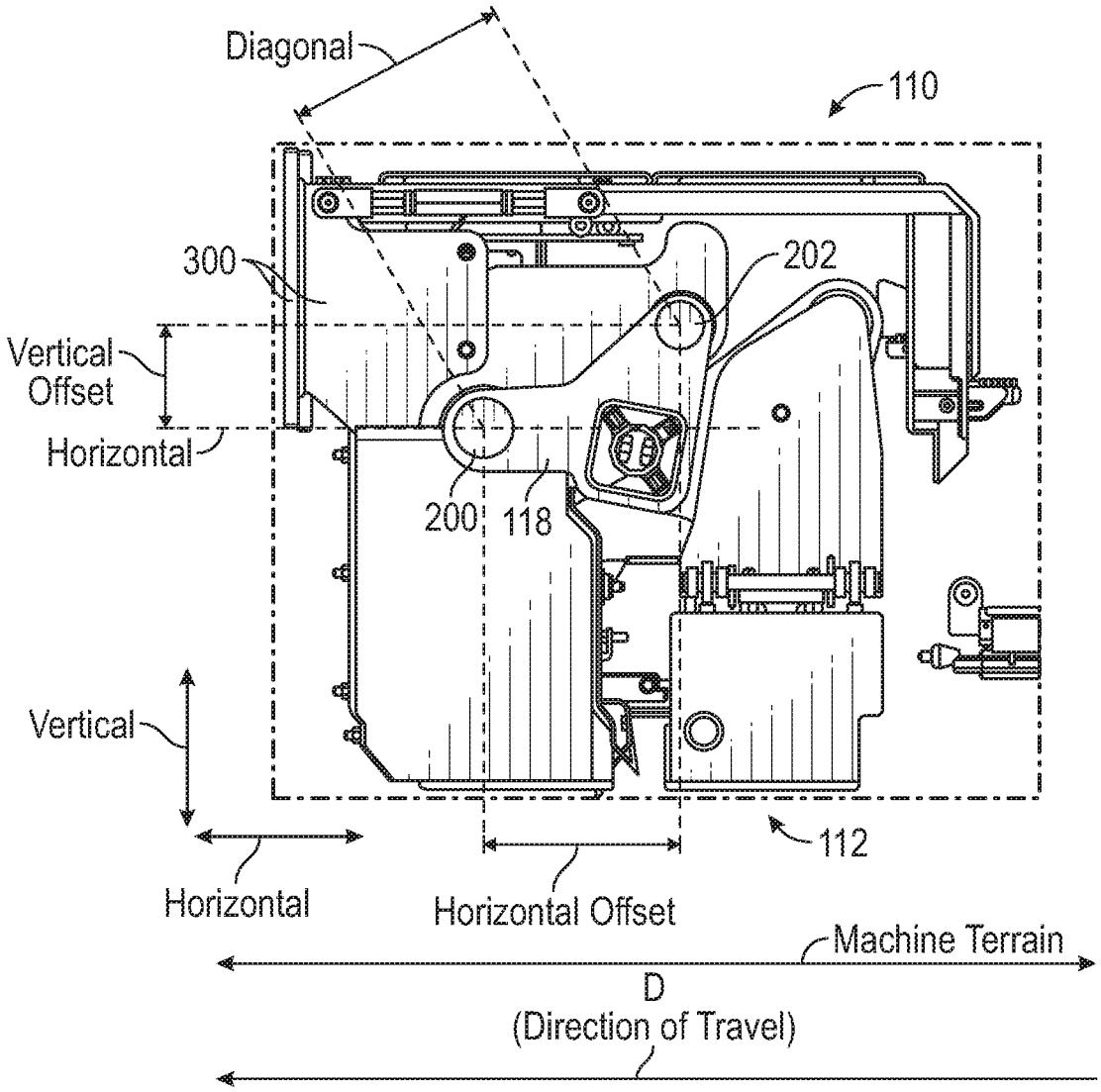
FIGS. 3A and 3B are elevation side views depicting portions of the extendable screed system of FIG. 1.

FIG. 3 is an elevation side view of portions of extendable screed system 102 of example paving machine 100, including main screed 110 and first extender screed 112. In FIG. 3A, first screed carriage 118 is again depicted movably coupled to main screed 110, and, in particular in this depiction to frame elements 300 of main screed 110 by first and second extender tubes 200 and 202, respectively. First and second tubes 200 and 202 are parallel to another. Additionally, second tube 202 is offset horizontally and vertically from the first tube 200, which, as depicted, means that first and second tubes 200 and 202 are diagonally arranged relative to one another.

Figure 3B:
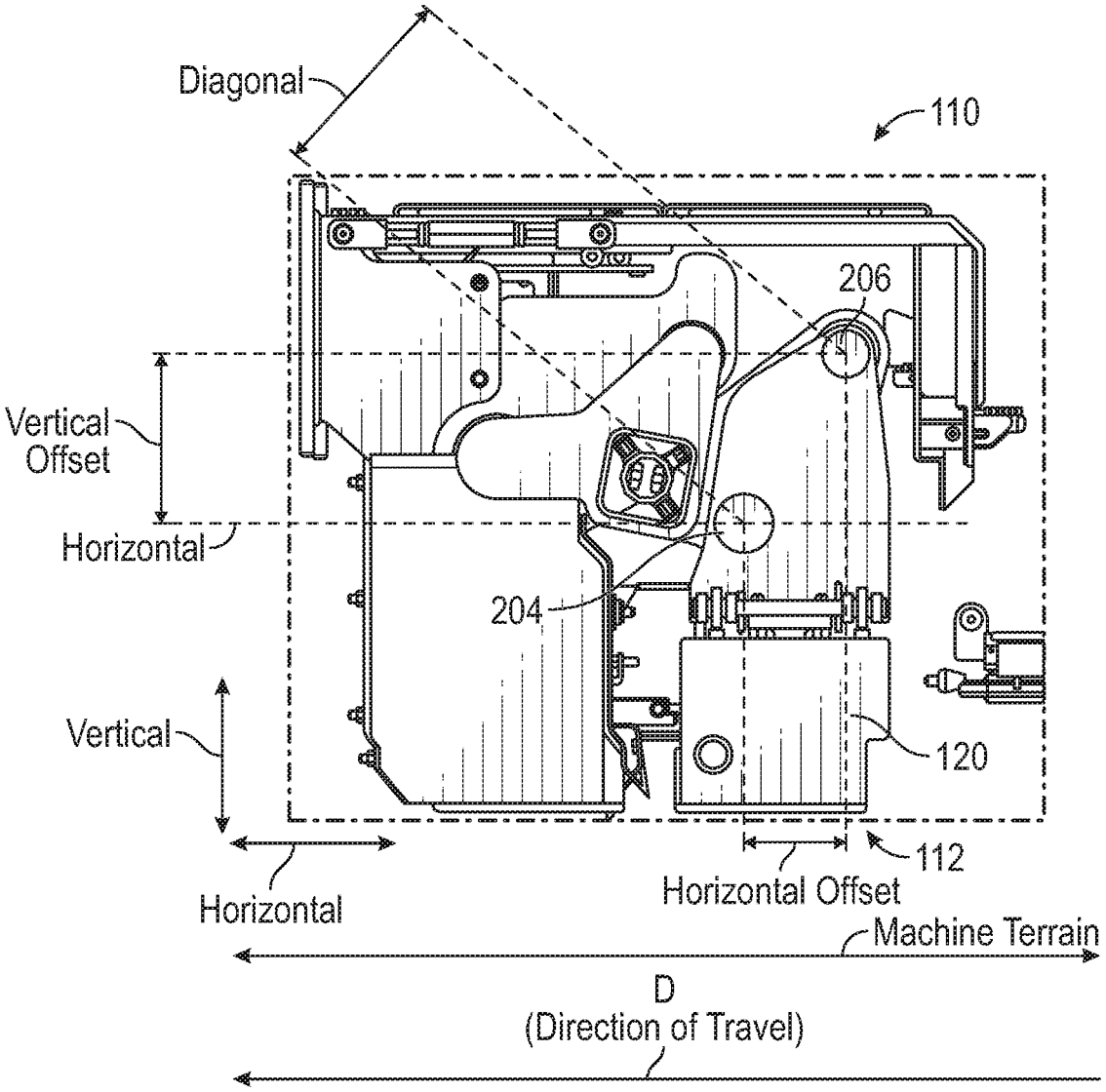

Additionally, in FIG. 3B, second screed carriage 120 is again depicted movably coupled to first screed carriage 118 by third and fourth extender tubes 204 and 206, respectively. Third and fourth tubes 204 and 206 are parallel to another. Additionally, fourth tube 206 is offset horizontally and vertically from the third tube 204, which, as depicted, means that third and fourth extender tubes 204 and 206 are diagonally arranged relative to one another.

First screed carriage 118 is arranged forward of second screed carriage 120. The diagonal angle of first and second tubes 200 and 202, respectively, is different than the diagonal angle of third and fourth tubes 204 and 206, respectively. In an example according to this disclosure, the diagonal angle of first and second tubes 200 and 202 is in a range from and including 20 degrees to and including 40 degrees. In an example, the diagonal angle of third and fourth extender tubes 204 and 206 is in a range from and including 70 degrees to less than 90 degrees. In an example, the diagonal angle of first and second tubes 200 and 202 is approximately 28.4 degrees. In an example, the diagonal angle of third and fourth tubes is approximately 78 degrees. The diagonal angle of the tubes of an extender screed in accordance with this disclosure can vary depending upon the particular loads, components, arrangement, etc. of the particular work machine with which the extender screed is associated and the particular terrain and/or paving material on which the machine is configured to work.

Examples according to this disclosure also include methods of making an extendable screed system for a paving machine. For example, such a method can include movably coupling an extender screed to a main screed. The extender screed is configured to move laterally relative to the main screed. The extender screed includes a first screed carriage movably coupled to the main screed by a first extender tube and a second extender tube diagonally arranged relative to the first extender tube. The extender screed also includes a second screed carriage movably coupled to the first screed carriage by a third extender tube and a fourth extender tube diagonally arranged relative to the third extender tube.

In another example, a method of making an extendable screed system can include movably coupling an extender screed to a main screed. The extender screed is configured to move laterally relative to the main screed. The extender screed includes a first screed carriage movably coupled to the main screed by a first extender tube and a second extender tube. The second tube is parallel to and offset horizontally and vertically from the first tube. The extender screed also includes a second screed carriage movably coupled to the first screed carriage by a third extender tube and a fourth extender tube. The fourth tube is parallel to and offset horizontally and vertically from the third tube.

INDUSTRIAL APPLICABILITY

A paving or other work machine including an extendable screed system in accordance with this disclosure is configured to spread, level and at least partially compact various materials, including asphalt, as an example. The paving machine has front and rear/back ends. Generally speaking, the material to be laid onto terrain (for example, a road or work surface) is arranged or received at the front end of the work machine and conveyed toward the back end of the machine, where the extendable screed system processes the material by spreading the material out to a prescribed or target width with a prescribed or target depth/height, leveling the layer of material and at least partially compacting the material before additional material processing steps, e.g., additional compaction by a drum compactor machine.

The paving machine travels with the front end of the machine leading in a direction, D, from the back toward the front of the machine. Loose paving material can be deposited onto a work surface over which the paving machine travels. The paving machine can include a system like an elevator for moving loose paving material into a hopper or other reservoir/container of the machine. The paving machine can travel forward and either be loaded with or load the paving material, while a conveyor system moves paving material through the machine in the opposite direction from the front of the machine toward the extendable screed system disposed at/toward the back of the machine.

In one example, an elevator picks up loose paving material in front of the paving machine, as the machine travels forward, and deposits the material into a hopper or other reservoir. The loose material deposited in the hopper can then be conveyed toward a feed system, which feeds the material out of the back of the machine and into the extendable screed system. The paving material is processed by the screed system and, after processing and trailing the machine, an at least partially compacted pad of paving material is laid including a consistent width and depth/height.

The paving machine includes the extendable screed system to accommodate different widths of paving material. The extendable screed includes two screed carriages, each of which is movably coupled to a main screed by two extender tubes. The two extender tubes of each of the two extender screed carriages are diagonally arranged relative to one another to counteract/accommodate operational forces in or with part or all of the force in multiple directions encountered by the screed system. Example paving or other work machines including such screeds may provide increased stiffness/strength/rigidity between the main screed frame and the extender screed(s) so that the extender screeds do not deflect an excessive amount under load, which, in turn can improve the uniformity and/or other quality related characteristics of the finished material mat produced by the machine.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. An asphalt paver machine comprising:

a main screed; and an extender screed coupled and configured to move laterally relative to the main screed, the extender screed comprising:

a first screed carriage movably coupled to the main screed by a first cylinder and a second cylinder diagonally arranged relative to one another; the first cylinder being arranged below and forward of the second cylinder; and a second screed carriage movably coupled to the first screed carriage by a third cylinder and a fourth cylinder diagonally arranged relative to one another, the third cylinder being arranged below and forward of the fourth cylinder, wherein the diagonally arranged first and second cylinders and a horizontal reference of the machine define a first acute diagonal angle, wherein the diagonally arranged third and fourth cylinders and the horizontal reference define a second acute diagonal angle, and wherein the second acute diagonal angle is greater than the first acute diagonal angle.

2. The machine of claim 1, wherein the first carriage is disposed forward of the second carriage.

3. The machine of claim 1, wherein one or more of the first, second, third, and fourth cylinders comprise at least one of a circular and a rectilinear cylinder.

4. The machine of claim 1, wherein the first acute diagonal angle is in a range from and including 20 degrees to and including 40 degrees.

5. The machine of claim 4, wherein the first acute diagonal angle is approximately 28.4 degrees.

6. The machine of claim 1, wherein the second acute diagonal angle is in a range from and including 70 degrees to and to less than 90 degrees.

7. The machine of claim 6, wherein the second acute diagonal angle is approximately 78 degrees.

8. The machine of claim 1, wherein the first cylinder is parallel to the second cylinder.

9. The machine of claim 1, wherein the third cylinder is pa el to the fourth cylinder.

10. The machine of claim 1, wherein the first cylinder comprises a larger cross-section than the second cylinder.

11. The machine of claim 1, wherein the third cylinder comprises a larger cross-section than the fourth cylinder.

12. The machine of claim 1, wherein the extender screed is a first extender screed coupled to a first side of the main screed, and further comprising:

a second extender screed coupled and configured to move laterally relative to a second side of the main screed, the second extender screed comprising:

a third screed carriage movably coupled to the main screed by a fifth cylinder and a sixth cylinder diagonally arranged relative to one another; and a fourth screed carriage movably coupled to the third screed carriage by a seventh cylinder and an eighth cylinder diagonally arranged relative to one another.

13. An asphalt paver machine comprising:

a machine frame;

a main screed having a screed frame coupled to the machine frame; and an extender screed coupled to the main screed, the extender screed comprising:

a first screed carriage movably coupled to the main screed by a first extender tube and a second extender tube, the second extender tube parallel to and offset horizontally and vertically from the first extender tube, the first extender tube being arranged below and forward of the second extender tube, the horizontally and vertically offset first and second extender tubes and a horizontal reference of the machine defining a first acute diagonal angle; and a second screed carriage movably coupled to the first screed carriage by a third extender tube and a fourth extender tube, the fourth extender tube parallel to and offset horizontally and vertically from the third extender tube, the third extender tube being arranged below and forward of the fourth extender tube, the horizontally and vertically offset third and fourth extender tubes and the horizontal reference define a second acute diagonal angle, and wherein the second acute diagonal angle is greater than the first acute diagonal angle.

14. The machine of claim 13, wherein the first carriage is disposed forward of the second carriage.

15. The machine of claim 13, wherein one or more of the first, second, third, and fourth extender tubes comprise at least one of a circular and a rectilinear cylinder.

16. The machine of claim 13, wherein one or more of the first, second, third, and fourth extender tubes comprise an annular tube.

17. The machine of claim 13, wherein the first diagonal angle is in a range from and including 20 degrees to and including 40 degrees.

18. The machine of claim 17, wherein the first diagonal angle is approximately 28.4 degrees.

19. The machine of claim 13, wherein the second diagonal angle is in a range from and including 70 degrees to and to less than 90 degrees.

20. The machine of claim 19, wherein the first diagonal angle is approximately 78 degrees.

21. The machine of claim 13, wherein the extender screed is a first extender screed coupled to a first side of the main screed, and further comprising:

a second extender screed coupled to a second side of the main screed, the second extender screed comprising:

a third screed carriage movably coupled to the main screed by a fifth extender tube and a sixth extender tube, the sixth extender tube parallel to and offset horizontally and vertically from the fifth extender tube; and a fourth screed carriage movably coupled to the third screed carriage by a seventh extender tube and an eighth extender tube, the eighth extender tube parallel to and offset horizontally and vertically from the seventh extender tube.

22. An asphalt paver machine comprising:

a main screed; and an extender screed coupled and configured to move laterally relative to the main screed, the extender screed comprising:

a first screed carriage movably coupled to the main screed by a first cylinder and a second cylinder diagonally arranged relative to one another, the first cylinder being arranged below and forward of the second cylinder; and a second screed carriage movably coupled to the first screed carriage by a third cylinder and a fourth cylinder diagonally arranged relative to one another, the third cylinder being arranged below and forward of the fourth cylinder, wherein:

the first carriage is disposed forward of the second carriage;

the diagonally arranged first and second cylinders and a horizontal reference of the machine define a first acute diagonal angle in a range from and including 20 degrees to and including 40 degrees; and the diagonally arranged third and fourth cylinders and the horizontal reference define a second acute diagonal angle in a range from and including 70 degrees to and to less than 90 degrees.

23. A method of making an extendable screed system for a paving machine, the method comprising:

movably coupling an extender screed to a main screed, the extender screed configured to move laterally relative to the main screed, and the extender screed comprising:

a first screed carriage movably coupled to the main screed by a first extender tube and a second extender tube diagonally arranged relative to the first extender tube, the first extender tube being arranged below and forward of the second extender tube, the diagonally arranged first and second extender tubes and a horizontal reference of the machine defining a first acute diagonal angle; and a second screed carriage movably coupled to the first screed carriage by a third extender tube and a fourth extender tube diagonally arranged relative to the third extender tube, the third extender tube being arranged below and forward of the fourth extender tube, the diagonally arranged third and fourth extender tubes and the horizontal reference define a second acute diagonal angle, and wherein the second acute diagonal angle is greater than the first acute diagonal angle.

* * * * *